United States Patent [19]

Manizza

[11] 4,316,538

[45] Feb. 23, 1982

[54] BOTTLE PACKAGE WITH PROMOTIONAL CARD INSERT

[75] Inventor: Guelfo A. Manizza, Blauvelt, N.Y.

[73] Assignee: Federal Paper Board Company, Inc., Montvale, N.J.

[21] Appl. No.: 184,639

[22] Filed: Sep. 8, 1980

[51] Int. Cl.[3] ..... B65D 77/24; B65D 85/62; B65D 75/54

[52] U.S. Cl. ..... 206/216; 206/45.34; 206/232; 206/459; 206/158

[58] Field of Search ..... 206/216, 232, 427, 158, 206/459, 45.34

[56] References Cited

U.S. PATENT DOCUMENTS

| | | | |
|---|---|---|---|
| 2,260,064 | 10/1941 | Stokes | 206/232 |
| 2,996,180 | 8/1961 | Bruce | 206/459 |
| 3,151,802 | 10/1964 | Spery | 206/216 |
| 3,542,193 | 11/1970 | Hewlett et al. | 206/459 |
| 3,767,038 | 10/1973 | Channing et al. | 206/459 |
| 4,139,094 | 2/1979 | Berry et al. | 206/158 |

*Primary Examiner*—William T. Dixson, Jr.
*Attorney, Agent, or Firm*—FitzGibbon, Roehrig, Greenawalt & Gilhooly

[57] ABSTRACT

A promotional card of paperboard is provided for incorporating in a package of stubby type beverage bottles which are disposed in double row transversely paired relation and held in a group by a molded plastic shroud or bonnet having a top panel with apertures for receiving capped portions of the bottles and for seating beneath the bottom edges of the cap skirts and snuggly engaging the outermost top portions of the bottles, the promotional card comprising a flat blank which is trapped beneath the shroud and which is cut and scored to fit over a center pair of capped bottles with outer end portions conforming generally to interior face portions of the shroud and terminating adjacent bottom edges of the shroud.

6 Claims, 4 Drawing Figures

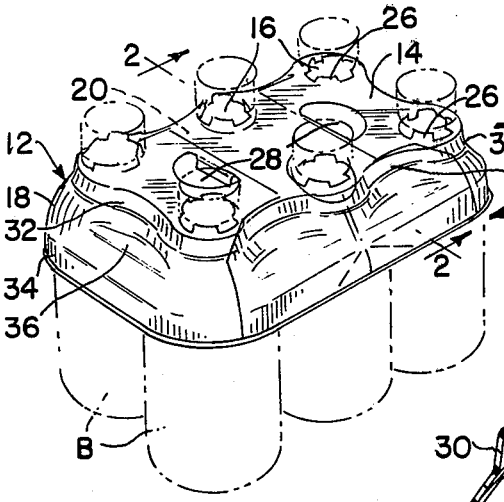
FIG. 1
FIG. 2
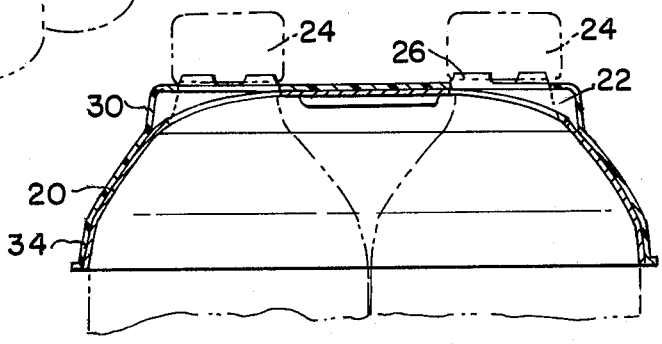
FIG. 3
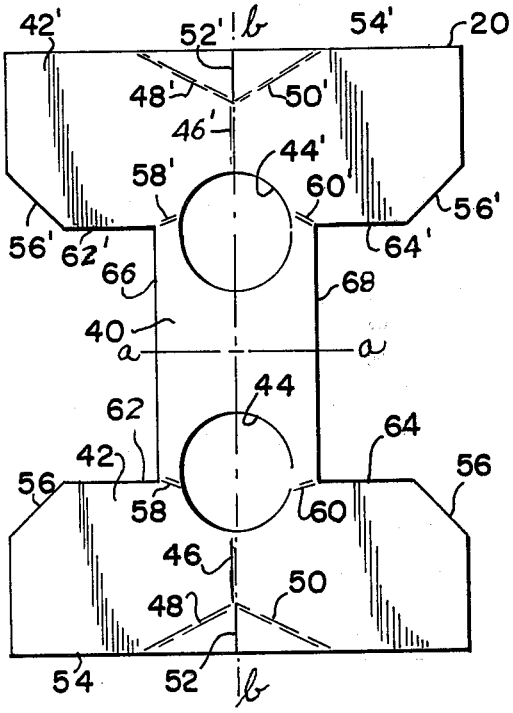
FIG. 4
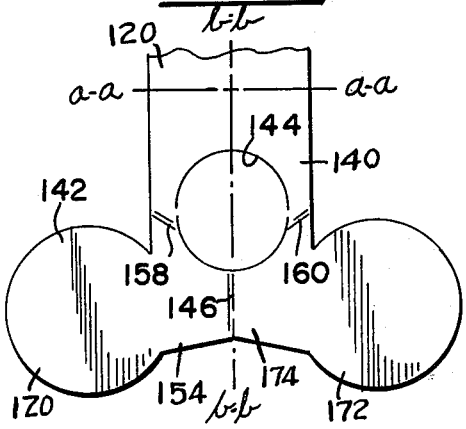

BOTTLE PACKAGE WITH PROMOTIONAL CARD INSERT

BACKGROUND OF THE INVENTION

This invention relates to packaging and is more particularly concerned with improvements in carrier packages for an assembly or group of articles in the form of bottles which are secured in grouped arrangement by means of a cap gripping plastic shroud and is more partituclarly concerned with an improved arrangement in which there is incorporated in the package a promotional card insert of paperboard or similar foldable sheet material.

In a recently developed packaging arrangement for marketing a group of so-called stubby type beverage bottles the bottles are disposed in double line and transversely paired relation and a plastic shroud having a top panel, with openings for the bottle necks and depending peripherial sidewall portions, is forced down over the tops of the bottles and into relatively tight engagement with top portions of the bottles, the sidewall portions being molded or shaped in part to conform to portions of the bottles at the outside periphery of the group and the bottom margin of the shroud being in part in the form of a relatively narrow band which is of generally rectangular configuration with rounded corners which encircle in part the bottles at the four corners of the group.

While the shroud in this type package is wholly or partially transparent it covers a goodly portion of the normally visible areas of the bottles and reduces the areas available for product identification, advertising and Promotional material which, as a practical matter, cannot be incorporated in the shroud itself in a satisfactory manner. Consequently, there has developed a desire, on the part of the bottlers and others involved in the marketing of the products, for an inexpensive addition to the package to enable the package to be made more competitive with other bottle packaging arrangements.

SUMMARY OF THE INVENTION

It is therefore a general object of the invention to provide a relatively inexpensive insert for incorporation in the package described which can serve a variety of product identification, advertising and/or promotional purposes.

It is a more specific object of the invention to provide an insert for a package of the type described which is in the form of a paperboard card cut and creased so as to enable it to be readily positioned on the group of bottles and applied without interfering with the normal application of a top gripping and encasing shroud.

It is a further object of the invention to provide in a bottle package of the type described an insert in the form of a card of foldable sheet material, such as, cardboard or like material, and capable of being cut to a variety of configurations for application to the tops of a portion of the bottles so as to nest within the shroud and conform at its opposite ends, at least in part, to the inside contour of the shroud where it is visible but inaccessible for removal until the package is at least partially disassembled.

The invention which is herein described and claimed comprises a carrier package for articles in the form of bottles which comprises an assembly of the articles disposed in double row and transversely paired arrangement with a carrier forming plastic shroud having a top panel with apertures to receive the bottle necks and a depending skirt formation encompassing in tight engagement top portions of the articles below the necks thereof and an insert in the form of a card of foldable sheet material having a top panel with a pair of apertures for receiving the neck portions of a central pair of the articles and end portions which lie on the interior face of the shroud skirt formation.

The foreoing and other objects and advantages of the invention will become more apparent when reference is made to the accompanying detailed description of the preferred embodiments of the invention which are set forth in the accompanying drawings wherein like reference numerals indicate corresponding parts throughout.

BRIEF DESCRIPTION OF THE DRAWINGS

FIG. 1 is a perspective view of a six bottle package which embodies the principle features of the invention, with the bottles being shown in phantom line;

FIG. 2 is a cross sectional view to an enlarged scale, taken on the line 2—2 of FIG. 1, and with the lower portions of the bottles being broken away;

FIG. 3 is a plan view of card insert which is cut and scored for insertion in the package of FIG. 1; and FIG. 4 is a partial plan view of a card insert which is cut to provide a somewhat different configuration.

DESCRIPTION OF THE PREFERRED EMBODIMENT

Referring to the drawings there is illustrated in FIG. 1 a bottle package 10 wherein a group of six bottles B are arranged in double row transversely paired relation and held in group forming relation by a shroud, or bonnet, 12 which is formed of a transparent, or semi-transparent, plastic material adapted to be shaped by molding or thermoforming so as to provide a top panel 14 having apertures 16 arranged in pairs for receiving the capped tops of the bottles and a depending skirt formation 18 extending about the peripheral edge of the top panel 14. An insert in the form of a paperboard card 20 is apertured to straddle the center pair of bottle necks and is seated against portions of the inner face of the shroud 12 so as to be locked in place by the latter.

In the form of the package which is illustrated the bottles B are the short neck type, generally referred to as "stubbies", with a very small neck portion 22 (FIG. 2) terminating at a mouth which may have a screw on, or pressed on, cap 24. The shroud 12 is apertured and specially designed, or shaped, to be forced down over the caps 24 and snugly engage outermost areas of the neck and adjoining top portions of the bottles B with maximum engagement of the bottle areas at the four corners of the group or assembly thereof. The top panel 14 of the shroud 12 has the apertures 16 arranged and spaced according to the bottle arrangement and spacing with each aperture 16 being of a size to accommodate the cap 24 and having inwardly projecting peripheral spaced bendable lug formations 26 which are adapted to engage beneath the bottom edge of the skirt of the associated cap 24. A pair of finger apertures or holes 28 located in the space between the bottles affords a convenient means for picking up the package. The skirt formation 18 of the shroud 12 is shaped to provide a narrow band formation 30 at the periphery of the top panel 14 which is bowed inwardly in the areas between the bottles as indicated at 32. A narrow band formation 34 forms the bottom margin of the shroud 12 which is of rectangular formation and tightly grips an appreciable area at the top portions of the corner bottles while bridging the space between the same and engaging a sufficient area of the outboard portions of the center pair of bottles to hold them in the group arrangement. The material between the band formations 30 and 34 tapers downwardly and outwardly and conforms to the general shape of the top outboard portions of the bottles with inward bowing between the bottles in the same manner as the top band formation 30, as indicated at 36. At the corners the shroud 12 hugs the bottle surfaces and the top of the bottom band formation 34 merges with adjoining portions of the shroud wall. The bottom periphery of the shroud may have a very narrow flange like formation 38 that extends outboard of the wall.

The insert 20, as shown in FIG. 3, is formed from a paperboard sheet of relatively light gauge which is cut in a generally H-shaped configuration so as to provide a small rectangular center panel 40 with cross panels 42, 42' at opposite ends. The insert is symmetrical about a center line a-a and the panel 40 has sufficient width dimension to accommodate identical bottle neck accommodating apertures 44, 44' which are equally spaced from the center line a-a and extend into the cross end panel portions 42, 42'. The apertures 44, 44' are elliptical in shape as shown for reasons hereafter described and are spaced according to the spacing of the middle pair of bottles in the group. The end panel portions 42, 42' are generally rectangular and are dimensioned in the direction parallel with the center line a-a so as to provide substantial display areas. In the form shown, when in place in the package, the end panels 42, 42', which are adapted to lie beneath the sidewall of the shroud 12, extend approximately between the vertical centers of the end bottles or corner bottles in the group. To facilitate bending of the panel end portions 42, 42' to conform to the shroud wall configuration these panels are scored and cut on a center line b-b which is normal to the center line a-a. Scores 46, 46' extend from the apertures 44, 44' to the intersections of pairs of outwardly diverging score lines 48, 50 and 48', 50' and cutting lines 52, 52', with the latter extending to the outboard edges 54, 54' of the panels. The panels 42, 42' are cut away at their inboard outermost corners as indicated at 56, 56'. In addition small score lines 58, 60 and 58', 60' extend from the periphery of the apertures 44, 44' to the inboard edges 62, 64 and 62', 64' where they intersect the side edges 66, 68 of the center panel 40.

A modified insert 120 is illustrated in FIG. 4 which is provided with end or side panels 142 having a panel configuration. In this form the center panel 140 may be substantially the same as the panel 40 in FIG. 4, with a pair of bottle neck receiving apertures 144 disposed on opposite sides of a center line aa-aa and properly spaced according to the bottle size, spacing and arrangement. The end or side panels 142 are each cut in the form of two circular portions 170 and 172 with a center joining panel portion 174 outboard of the aperture 144 which joining portion 174 is divided by a cutting line 146 with the latter on the transverse center line b—b and divided by a cutting line 146 extending from the aperture 144 to the outboard edge 154 of the panel 142. The edge 154 is notched out between the two circular panel portions 170 and 172 as shown. In a typical use the circular portions 170 and 172 may be printed with the picture or pictures of an athletic figure or figures, or they may serve as discount coupons to induce repeat buying of the product or purchase of other porducts. At the inboard edges the panels 142 are provided with scores 158 and 160 corresponding to the scores 58 and 60 in FIG. 3 for the same purpose, that is, to facilitate bending and conforming to the inside face of the shroud member so as to insure visibility of any printed matter on the surface.

The inserts 20 and 120 are shaped and dimensioned so as to enable the application of the same to the bottle group without interference with the application of the shroud 12, either separately, or simultaneously with the shroud 12, by means of appropriate apparatus.

We claim:

1. An article package comprising a group of articles having the general form of short neck bottles with cap type closures, which articles are arranged in double row transversely paired relation and held in group arrangement by a top gripping shroud formed of a continuous plastic which is at least semi-transparent and which is shaped or otherwise formed so as to provide a top wall forming panel and a depending sidewall formation extending about the perimeter of the top wall forming panel, said top wall forming panel having apertures therein which are in row relation, and spaced according to the spacing of the articles so as to fit down over the necks of the articles with portions of the edges of the apertures engaging beneath depending skirt forming portions of the cap closures, said sidewall formation extending in the form of a band about top portions of the articles and having a depth which extends below at least to the bottom of the neck forming portions of the articles with a peripherial dimension which results in tightly gripping outboard portions of the surfaces of the corner articles in the group, and a promotional display card of bendable sheet material trapped between the shroud and the top portions of the articles, which display card has a center panel with spaced apertures adapted to accommodate the neck portions of the middle row of articles and panel formations at opposite ends of the center panel which extend approximately to the bottom edges of the side wall formation and which lie in close proximity to the inner face of the sidewall formation so that display material on the surface is visible through the shroud material.

2. In a package comprising a plurality of articles having the general shape of short neck beverage bottles which are disposed in double row and transversely paired relation, and a plastic article gripping and carrying shroud member which includes an apertured top panel for receiving neck portions of the articles and a depending skirt formation extending in gripping relation about portions of the articles which adjoin the neck portions, a display card having a central top panel portion with a pair of apertures transversely spaced according to the spacing of a center pair of the articles and configured to receive the article neck portions and having end panel portions of greater dimension than the central panel portion in the direction of the rows of the articles and folded down along the outside perimeter of the articles so as to be located closely adjacent to the inner surface of the skirt portion of the shroud member.

3. In a package as set forth in claim 2 wherein the display card is dimensioned so that the dimension thereof transversely of the group of articles corresponds approximately to the corresponding dimension of the shroud member.

4. In a package as set forth in claim 2 wherein the transverse end margins of the display card terminate on lines which do not extend appreciably below the bottom margins of the skirt of the shroud member.

5. In a package as set forth in claim 2 wherein the display card has a pair of apertures of sufficient size to receive capped articles and inwardly extending lug members on the periphery of each aperture which extend inwardly a sufficient distance to engage beneath the bottom edge of the skirt of a cap on the mouth of the article seated therein.

6. In a package as set forth in claim 2 wherein the display card has end panel portions which are scored so as to be bendable on a transverse center line so as to better enable the end portions to assume a shape conforming to the inner face portions of the overlying skirt portion of the shroud member.

* * * * *